US008427051B2

(12) United States Patent
Riva et al.

(10) Patent No.: US 8,427,051 B2
(45) Date of Patent: Apr. 23, 2013

(54) SUPPORT FOR FILIFORM ELEMENTS CONTAINING AN ACTIVE MATERIAL

(75) Inventors: Mauro Riva, Cantello (IT); Alessio Corazza, Como-Camnago Volta (IT); Stefano Paolo Giorgi, Biassono (IT); Werner Juhr, Köln (DE)

(73) Assignee: SAES Getters S.p.A., Lainate (MI) (IT)

( * ) Notice: Subject to any disclaimer, the term of this patent is extended or adjusted under 35 U.S.C. 154(b) by 19 days.

(21) Appl. No.: 12/936,388

(22) PCT Filed: Jul. 7, 2010

(86) PCT No.: PCT/EP2010/059706
§ 371 (c)(1),
(2), (4) Date: Oct. 4, 2010

(87) PCT Pub. No.: WO2011/006811
PCT Pub. Date: Jan. 20, 2011

(65) Prior Publication Data

US 2011/0204774 A1 Aug. 25, 2011

(30) Foreign Application Priority Data

Jul. 15, 2009 (IT) ..... MI2009A1255
Mar. 24, 2010 (IT) ..... MI20100085 U

(51) Int. Cl.

| | |
|---|---|
| ***H01J 17/22*** | (2006.01) |
| ***H01J 17/24*** | (2006.01) |
| ***H01J 19/70*** | (2006.01) |
| ***H01J 61/26*** | (2006.01) |
| ***H01J 17/26*** | (2006.01) |
| ***H01J 61/28*** | (2006.01) |

(52) U.S. Cl.
USPC ..... 313/556; 313/547; 313/549; 313/550; 313/551; 313/553; 313/559; 313/558

(58) Field of Classification Search ..... 313/558, 313/559, 556, 561, 562, 551, 550, 553
See application file for complete search history.

(56) References Cited

U.S. PATENT DOCUMENTS

| | | | |
|---|---|---|---|
| 1,733,809 | A | 10/1929 | Lederer |
| 2,928,925 | A | 3/1960 | Thall et al. |
| 3,203,901 | A | 8/1965 | Della Porta |
| 3,657,589 | A | 4/1972 | Della Porta et al. |
| 3,733,194 | A | 5/1973 | Della Porta et al. |

(Continued)

FOREIGN PATENT DOCUMENTS

| | | |
|---|---|---|
| EP | 0669639 | 8/1995 |
| EP | 0691670 | 1/1996 |

(Continued)

OTHER PUBLICATIONS

PCT International Search Report for PCT/EP2010/059706 filed on Jul. 7, 2010 in the name of Riva, et al.

(Continued)

*Primary Examiner* — Karabi Guharay
*Assistant Examiner* — Zachary J Snyder
(74) *Attorney, Agent, or Firm* — Steinfl & Bruno LLP

(57) ABSTRACT

A support for filiform elements containing an active material in form of powders is described, comprising anchoring means of the support and blocking means for the filiform element, a method for manufacturing said support and lamps wherein said supports are employed.

23 Claims, 6 Drawing Sheets

U.S. PATENT DOCUMENTS

| | | | | |
|---|---|---|---|---|
| 4,278,908 | A * | 7/1981 | Antonis | 313/546 |
| 4,306,887 | A | 12/1981 | Barosi et al. | |
| 5,961,750 | A | 10/1999 | Boffito et al. | |
| 6,452,322 | B1 * | 9/2002 | Mukuno et al. | 313/481 |
| 6,456,004 | B1 * | 9/2002 | Johnson et al. | 313/552 |
| 2008/0169759 | A1 * | 7/2008 | Corrazza et al. | 313/562 |
| 2009/0021173 | A1 * | 1/2009 | Harzig et al. | 313/639 |

FOREIGN PATENT DOCUMENTS

| | | |
|---|---|---|
| EP | 0737995 | 10/1996 |
| GB | 1248184 | 9/1971 |
| GB | 2056490 | 3/1981 |
| JP | 3285232 | 12/1991 |
| WO | 98/53479 | 11/1998 |
| WO | 01/67479 | 9/2001 |
| WO | 03/029502 | 4/2003 |
| WO | 2006/008771 | 1/2006 |
| WO | 2006/090423 | 8/2006 |
| WO | 2007/099575 | 9/2007 |
| WO | 2007/111979 | 10/2007 |
| WO | 2009/156334 | 6/2009 |

OTHER PUBLICATIONS

PCT Written Opinion for PCT/EP2010/059706 filed on Jul. 7, 2010 in the name of Riva, et al.

* cited by examiner

SUPPORT FOR FILIFORM ELEMENTS CONTAINING AN ACTIVE MATERIAL

CROSS REFERENCE TO RELATED APPLICATIONS

The present application is the U.S. national stage of International Application PCT/EP2010/059706 filed on Jul. 7, 2010 which, in turn, claims priority to Italian Application MI2010U000085 filed on Mar. 24, 2010 and Italian Application MI2009A001255, filed on Jul. 15, 2009.

The present invention relates to supports for filiform elements containing an active material, comprising anchoring means for the supports and blocking means for the filiform element.

Said kind of supports is used in lamps, particularly but not exclusively in the so-called fluorescent low pressure mercury lamps, known in the field with the acronym FL, in lamps wherein the so-called burner is present, i.e. high-pressure discharge lamps (also known as high-intensity discharge lamps) and lamps containing phosphors in general. Moreover, these supports may be used in other electroluminescent sources exploiting the stimulation induced by the emission of electrons caused by thermionic effect or by field effect, such as e.g. the reduced size lighting devices used for the manufacturing of large size displays.

Said kinds of lamps and devices, notwithstanding their different nature and features, have a common problem, which is the step of introducing an active material, said material being different according to the kind of lamp or device.

In lamps and devices exploiting the technology known in the field as "electron-stimulated emission" for their operation, the active material may be an evaporable getter composition, which allows to e.g. dispense the desired amount of an alkaline-earth metal chosen among magnesium, calcium and barium. In high-intensity discharge lamps the active material usually employed is a non-evaporable getter alloy, but in some cases it may also be an evaporable getter composition.

In FL lamps the main problem is instead the mercury dosage whereas the secondary problem is the need to introduce also a getter material inside the lamp. Some solutions, such as the one shown in international application WO98/53479 in the name of the Applicant, show employment of filiform elements containing a compound for mercury release which may be directly fixed to a lamp component.

Patent application WO2006/0900423, in the name of the Applicant, shows solutions to introduce in lamps the getter materials (which are necessary to remove gaseous impurities which may jeopardize their working) in order to minimize possible dimming effects of the emitted light, whereas patent application WO 2009/156334, still in the Applicant's name, shows a way to arrange filiform elements inside the lamp.

Patent application US2009/0021173 discloses a carrier element for an active material. In this case the filiform element is fixed by welding or by an adhesive on the carrier, that is a square planar or a rolled narrow band. Filiform elements are fitted in lug or depression of a carrier element with larger area to be fixed to the power line of the lamp.

All the previous solutions, although suitable for introducing the filiform element into the lamps, still have some drawbacks. In fact the simplest process to fix a filiform element in a device requires a welding process, typically an electrical welding by means of the so-called spot-welding process, or possibly a laser welding, which involves a local heating that may heat some portions of the filiform element to high temperatures, in some cases higher than 500° C.

This heating may involve various shortcomings related to the kind of powders that form the active material contained inside the filiform element. In particular in the case of the getter materials, said heating may bring to an early activation during intermediate steps of the manufacturing process of the lamp, for example before its hermetic sealing, with consequent reduction of the gas sorption capacity thereof due to oxidation of the material. If mercury-releasing materials are present, the local heating may lead to undesired emission of mercury in intermediate steps of the process with consequent problems due to contamination resulting from mercury. A reduction of the yield in the release of this element, moreover, may also be observed as effect of oxidation phenomena. In some kind of lamps the filiform element contains both mercury releasing powders and getter powders, so that in this case both deterioration phenomena of the active material and early release may occur.

The above drawbacks due to the undesired oxidation phenomena are also present when the active material has the purpose of releasing alkaline-earth materials. Also in this case, the deterioration is associated with heating outside the normal activation step of the active material, which takes place just before the end of the lamp production process and typically consists in heating at temperatures between 400° C. and 900° C. for times between fifteen seconds and a few minutes, according to the active material used.

The use of adhesive in lug or depression as alternative way of fixing the filiform element to support is not usually accepted as a good choice because adhesive usually does not resist to the activation temperature required by the active material.

Moreover, there is also an industrial problem related to the size of the devices: in view of their progressive miniaturization, an improved precision and method is requested for fixing the filiform elements, which have smaller and smaller size, to the device components In so small devices, a good fixing of the element containing the active material without the undesired collateral effects is a present problem in their manufacturing. For example "shadow effect" for small optoelectronic devices or lamps can be tentatively avoided only with the choice of particular positioning of the filiform element in them, that are not always applicable because strongly related to the device structure i.e. the presence of specific structural element where filiform could be put on in. It is therefore an object of the present invention to provide a support for introducing filiform elements containing an active material into lamps or devices, which also can be easily installed on any already existing element or component of the lamp or device and is capable of avoiding the localized heating of one or more parts thereof following to the introduction and fixing step without collateral effects as dimming, deterioration or difficulties associated to an effective activation of the active material at the right time.

These results are obtained by means of the present invention which in a first aspect thereof consists in a support for filiform elements containing an active material in powder form, comprising blocking means of each filiform element on said support, anchoring means for said support, characterized in that said blocking means exert a compression on the filiform element which is between 25 and 90 MPa.

The invention will be illustrated in the following with reference to the attached drawings, wherein.

Figure 4:
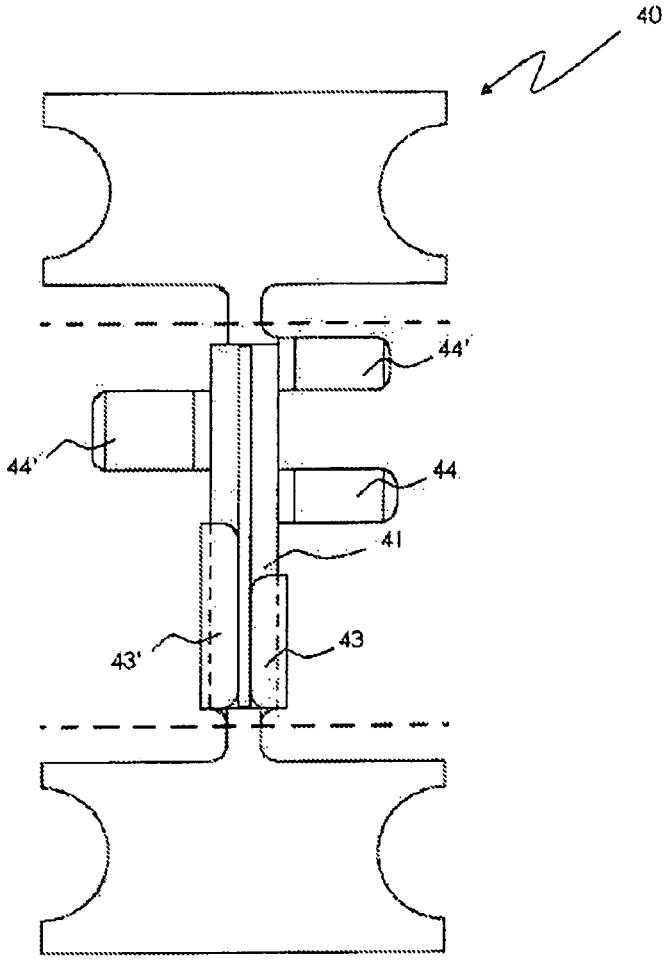
FIG. 4 shows a possible embodiment of a support according to the present invention.
Figure 4A:
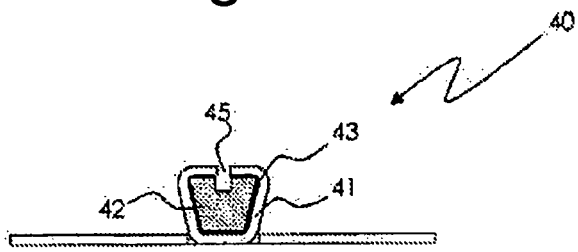
Figure 5:
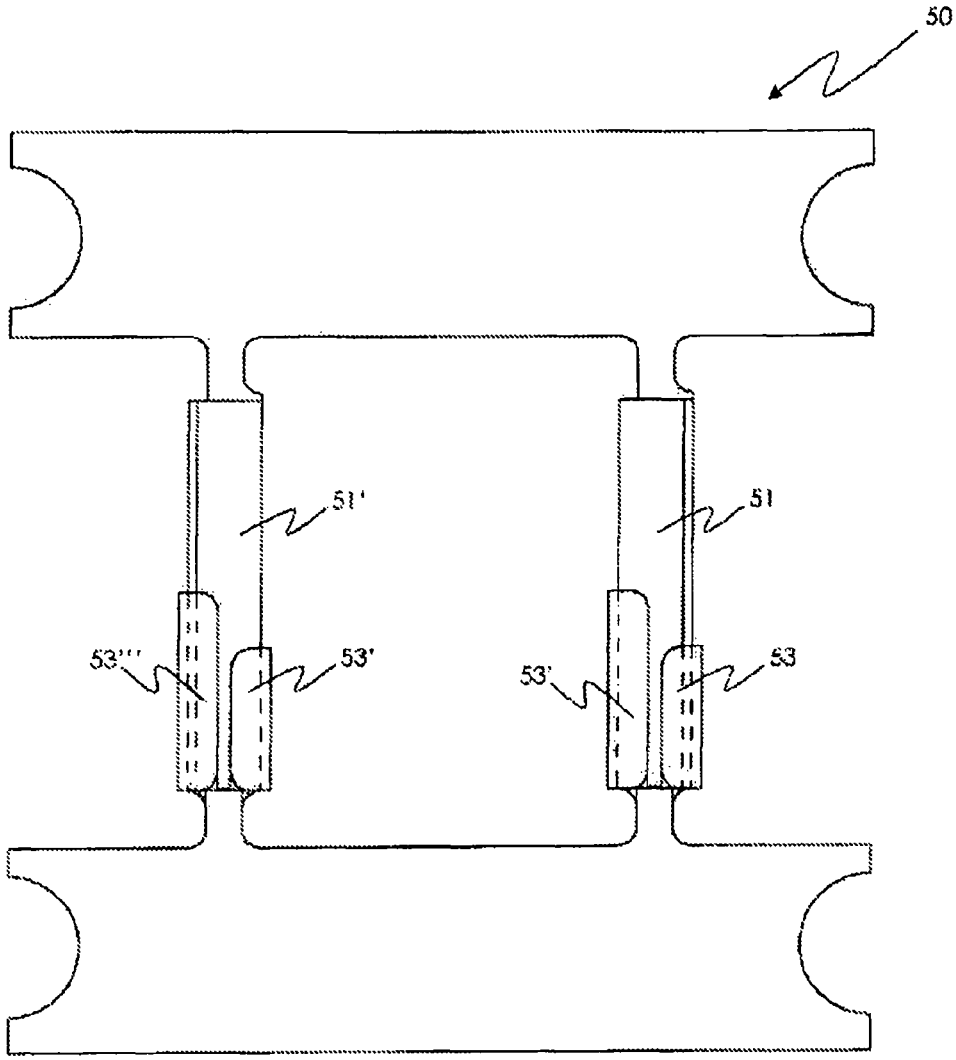
Figure 6:
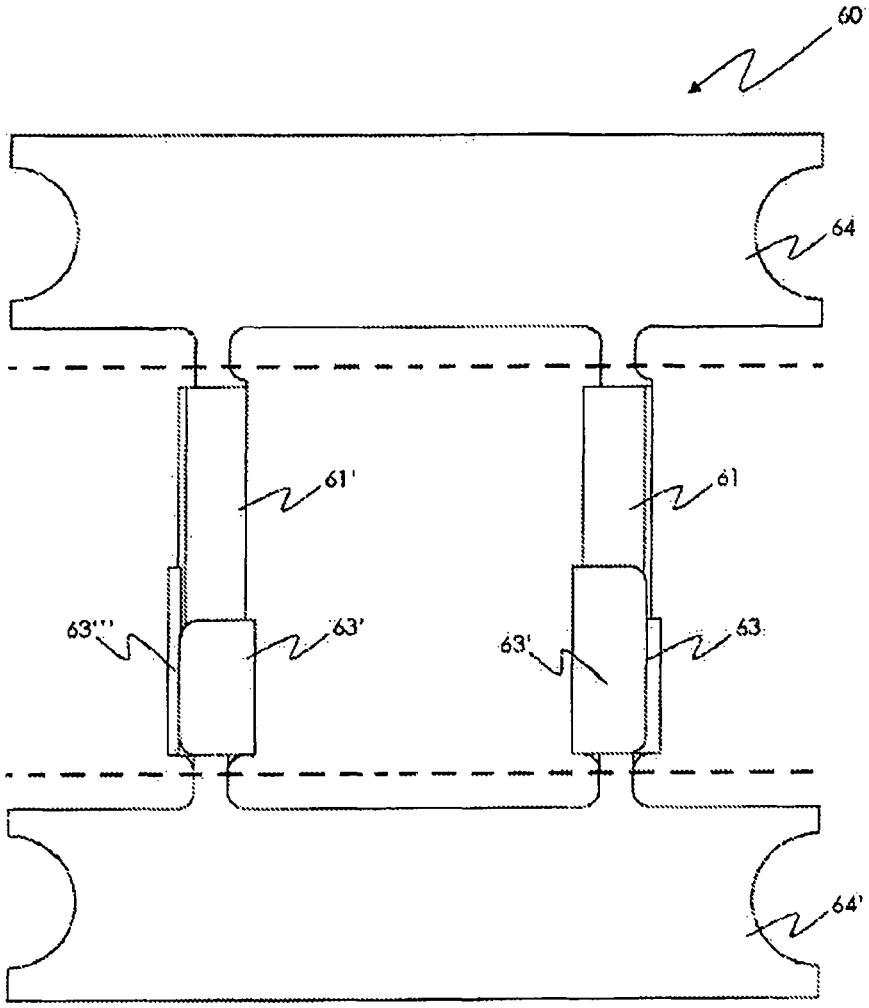
Figure 6A:
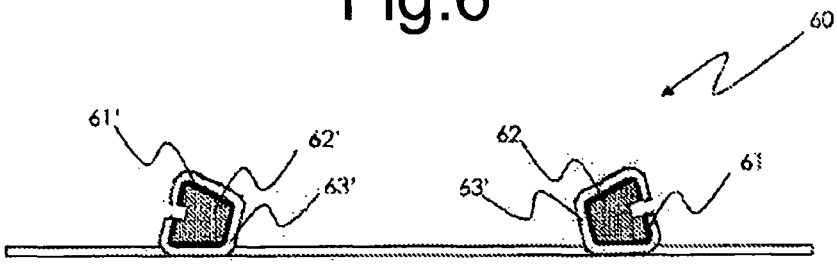
Figure 7:
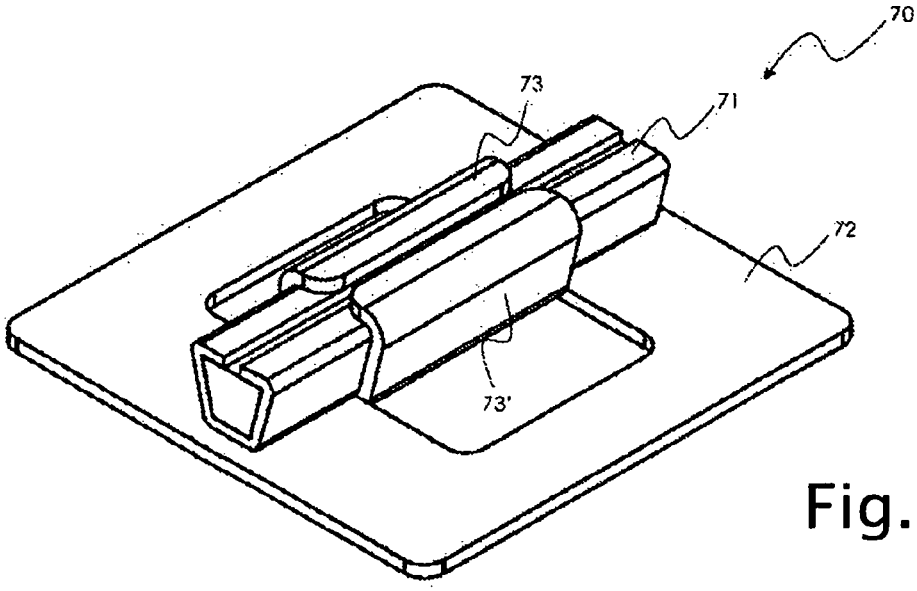
Figure 8:
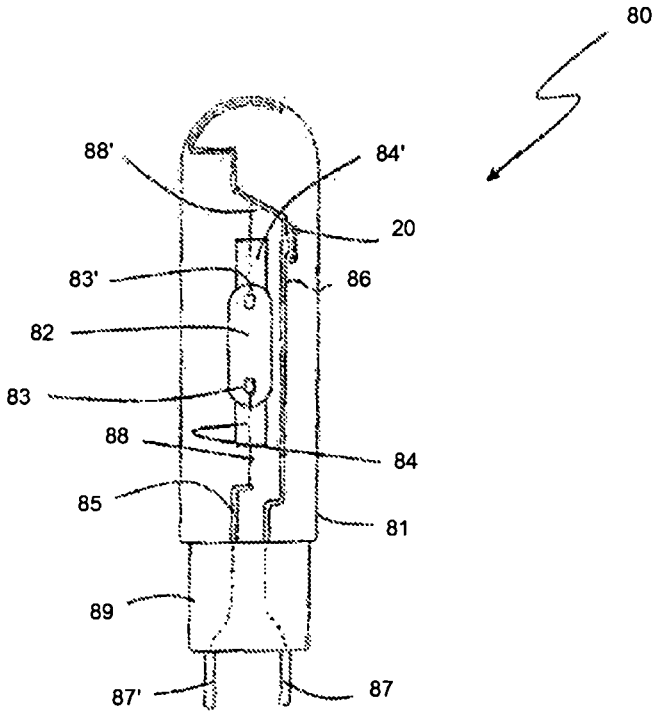

FIG. 4*a* shows a side view of the embodiment shown in FIG. 4;

FIG. 5 shows an alternative embodiment of a support for at least two filiform elements;

FIG. 6 shows a variant of the embodiment of a support shown in FIG. 5; and FIG. 6*a* shows a side view of the embodiment shown in FIG. 6;

FIG. 7 a possible alternative embodiment of a support for a filiform element according to the present invention;

FIG. 8 shows a cross-sectional view of a lamp containing a support for filiform elements containing an active material made according to the present invention.

In the drawings, the size and dimensional ratios of the various elements are not correct but sometimes appear altered in order to improve their comprehensibility: for example the powders of the active material are not shown as such, but the active material in the various figures is shown by use of full color.

In the present description and in the claims, by filiform element is intended an element having an elongated shape, with reference to the ratio between the length and lateral size thereof, that shall be of at least 2. Typically, the lateral size is lower than 1.5 mm. In the case of filiform elements having lateral section of complex shape (for example, trapezoidal), the ratio is referred to the larger lateral size.

As described in WO98/53479 relating to filiform mercury dispensers, the single element is typically manufactured starting from an element having a greater length by means of a cutting step. This allows simplifying the industrial manufacturing process and selecting the desired quantity of mercury and/or getter material by suitable selection of the length of the filiform element. A mechanical cutting process is preferred, because the lateral openings which are formed following to the cutting step are characterized by a compressing action of the powders, favoring their retention inside the filiform device.

Another type of filiform element and its manufacturing process are described in international application WO01/67479 in the name of the applicant. Also for this device a cutting step is used for obtaining the single filiform element.

Besides, it is possible that optionally the filiform element has a lateral slit which has the purpose of improving the functional features, for instance by favoring mercury release, or in case that the powders that form the active material comprise also a getter material, by increasing the surface that is directly in contact with the outside of the filiform element in order to favor sorption of the gaseous impurities.

As regards the definition of active material, this is generally formed of a mixture of powders, which may be powders of a plurality of compounds for mercury release, a plurality of getter materials, or mixtures thereof.

The inventors, in the course of their study of a solution allowing the introduction into the lamps of filiform elements containing an active material in powder form, had to tackle the peculiarities of such a device, deriving from the process used for its manufacturing.

As a consequence there are critical aspects of the device structure and of the possible blocking systems, which not only should avoid macroscopically damaging the structure of the filiform element, but also should not exert forces that could bring to leakage of powders of the active material.

In particular, the inventors have found that it is possible to use binding supports for filiform elements even using blocking means acting only to limited portions of its length, but these should not exert an extreme compression action on the filiform element. This action should be not higher than 90 MPa, above which limit the functionality of the filiform element is compromised. Preferably, the compression to which the filiform element is subjected is not higher than 55 MPa, in order to avoid any possible risks of particle losses, risk heightened and not predictable as a consequence of the activation processes.

Another very important parameter is the minimum compression that the blocking means must exert in order to ensure the retention of the filiform element also during operation. This value is preferably not lower than 25 MPa. In fact inventors have discovered that the efficiency of the activation process (i.e. the heating to activate the getter and/or to release mercury when it is desired) is strongly related to the blocking effect on the filiform element.

In the case of blocking elements arranged in correspondence to at least one of the ends of the filiform element, which is the preferred solution, this corresponds to having a limit on the reduction of the lateral area at the end of the filiform element. This reduction can be easily measured with respect to the cross-section area of the central portion, or more generally with respect to a portion of the filiform element which is not in correspondence to the blocking elements. From the point of view of the geometric features of the filiform element, once mounted on the support it should have a reduction of the cross-sectional area lower than 8% and preferably lower than 5% ensuring that the powders inside the device are not subjected to the critical compression values which were previously cited. According to the preferred embodiment of the present invention it has been found that the reduction of the cross-section area of the filiform element is comprised between 1.5% and 4%: this guarantees an optimization of the filiform element mounting and, as secondary inexpected aspect, its activation efficiency In the case of blocking elements at the ends of the filiform element, which is one of the preferred solution, this corresponds to having such limit on the reduction of the lateral area at the end of the filiform element, with respect to the area of the central section or more in general of a portion of the filiform element which is not in correspondence of the blocking elements.

Figure 1:
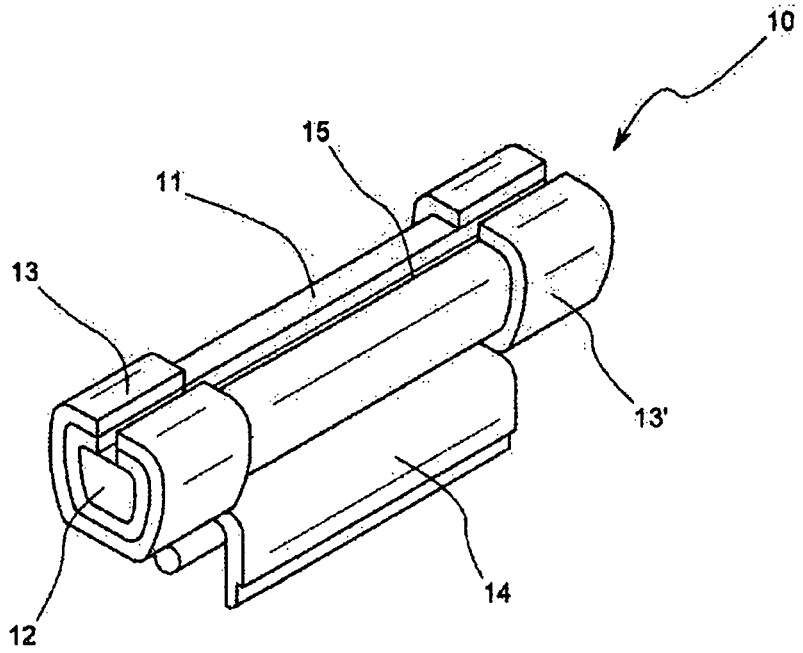
FIG. 1 shows a possible embodiment for a support according to the present invention.

FIG. 1 shows a support 10 for filiform elements 11, containing powders of an active material 12, on which blocking means 13, 13' and anchoring means 14 for binding the support to a device component are provided.

In the preferred embodiment shown in FIG. 1 the structure of the anchoring means 14 is of the plug-in pressure type, so as to allow easy setting up on a cylindrical component of, as for example, a discharge lamps, the metal element supporting the burner. Another alternative way for building anchoring means is by crimping a suitable metal element present on the support.

Besides, filiform element 11 has a slit 15 in the upper portion thereof, but, as previously cited, the support according to the invention can also be applied to filiform elements that are not provided with a slit on the side thereof. Further, the filiform element 11 can be positioned in such a way that the slit is not necessarily turned towards the upper portion of the support, but it can be turned anywhere else, even towards the support base.

These considerations regarding the presence and positioning of the slit of the filiform element are also applied to the following figures.

A first alternative embodiment of this support comprises a single blocking element positioned at the central portion of the filiform element.

Figure 2:
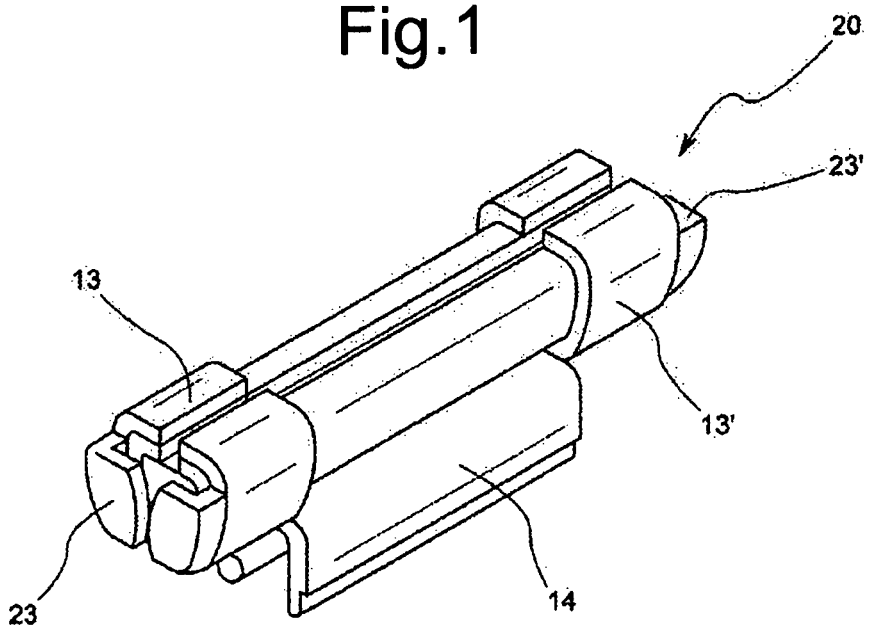
FIG. 2 shows a preferred embodiment for a support according to the present invention.

In FIG. 2, the blocking means of support 20 are functionally characterized by two portions, a first portion 13 that exerts the blocking action by compression of the lateral surface of the filiform element, whereas the terminal portion 23 of the blocking means is bent towards the lateral portion of the filiform element; this determines that the filiform element is retained on the support not only by the action of the force exerted by the blocking elements on the surface of the filiform element, but also by virtue of the action of the geometric tie.

In FIG. 2, the common elements with FIG. 1 have not been explicitly indicated, and in addition the bendings of the terminal portion 23 of the blocking means 13 are present also on element 13' (bending 23'). FIG. 2 shows a type of support according to the present invention with bending of the terminal portion of the blocking means, in particular with bending of two lateral flaps, however the same result could be obtained also with a single flap, or, more generally, by bending one or more portions of the blocking element.

Further, in FIG. 2 a bending at 90° has been shown, but also bendings at lower angles can serve the same function, as long as the area at the end of the cross-section of the blocking means after bending is lower than the cross-section area of the filiform element. In this case, it is preferable that the blocking means do not cover more than 60% of the area at the ends of the filiform element, in order to preserve its functionality, that is preventing or limiting the mercury release and/or limiting the getter functionality with particular reference to the sorption velocity.

Figure 3:
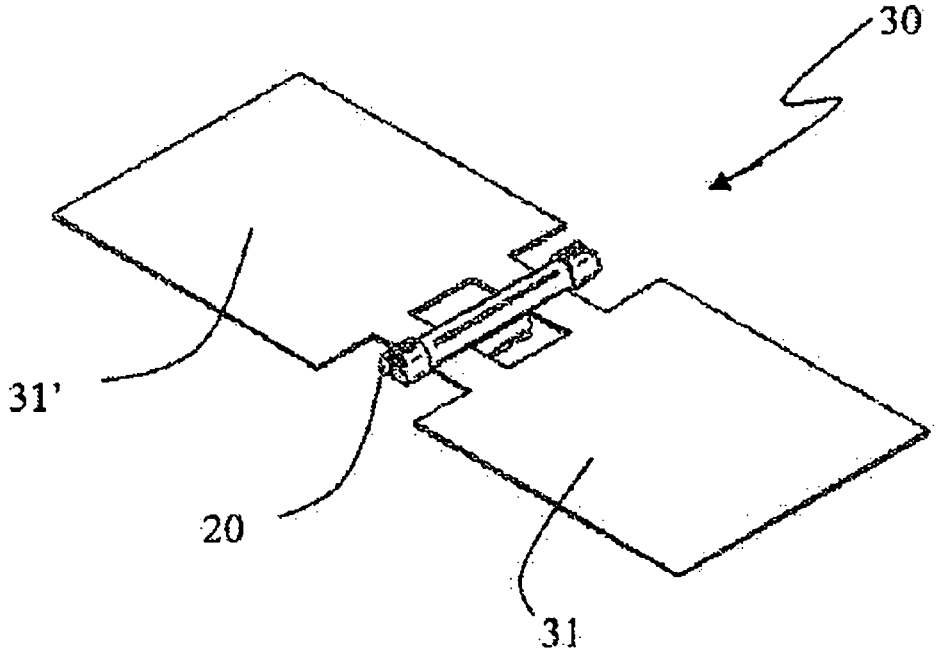
FIG. 3 shows an alternative preferred embodiment of a support for a filiform element.

FIG. 3 shows an alternative embodiment 30 for a support for filiform elements according to the present invention: in this case, a support 20, such as the one shown in FIG. 2, also has lateral metal extensions 31, 31', having the function of improving interception of the electromagnetic field which is typically used for the heating during the activation process of the active material, that is for the mercury release, activation of the getter material, or both.

In the case of use in FL, the metal lateral extensions could be useful, not only for favoring the activation process of the active material of the filiform element, but also for creating the so-called shield configuration for the electrodes in the lamps, being it formed as a ring around the electrodes or positioned as a hat above the electrode, which is typically positioned at a distance of few millimeters or in some case of the order of ten millimetres. FIGS. 4 and 4*a* show a support 40 for a filiform element 41 containing powders of an active material 42, at one end of which blocking means 43, 43', and anchoring means 44, 44', 44", . . . for restraining the support to a device component are provided. The drawings show three anchoring means having the same length. However, according to the device and the type of anchorage desired, the number of anchoring means may be changed as well as their shape and size on the basis of all the variants that one skilled in the art may conceive.

The blocking means are shown having a different size with respect to each other. However, the present invention also includes the particular case in which the blocking means have all the same size.

Moreover, the filiform element has a slit 45 in its upper portion, but, as previously discussed, the support of the invention may also be applied to filiform elements that do not have a side slit or, alternatively, the slit may face anywhere, also to the base of the support. These considerations as to the presence and the arrangement of the slit of the filiform element apply to all the possible embodiments disclosed by the present invention.

In a preferred embodiment the anchoring elements restrain elastically or by plastic deformation the support for filiform elements to one of the components forming the lamp, such as e.g. the wires supporting the burner, or electrical feedthroughs in high-pressure discharge lamps, or wires supporting the tungsten filament, called lead-wires, or additional wires, known under the name of third electrode, for supporting shielding members in FL.

A possible alternative may be to use the anchoring means as flags adhering to walls allowing the support to be restrained to the inside of a predefined portion of a tubular member present in the final device, such as e.g. at the portion of the evacuation pipe which is partially connected to one end of the lamp and known in the field as "exhaust tube". The support object of the invention, in the latter case, is correspondingly restrained to a portion of said tube having a reduced cross-section physically or by means of the elastic effect of the same anchoring fins. Generally, the support that can be used for this purpose is characterized by anchoring means having a length lower than those suitable for e.g. a crimping, welding or pressure plug-in process.

In one of its embodiments, e.g. the embodiment shown in FIG. 5, the invention provides for using supports blocking more than one filiform element. In the case specifically shown in this drawing two filiform elements 51, 51' having a slit 55, 55' are provided, the filiform elements being blocked by blocking means 53, 53', . . . similar to those shown in FIG. 4.

Moreover, FIGS. 6 and 6*a* show a possible variant of this embodiment. On equal relative positioning of the filiform elements 61, 61' so configured that the slits 65, 65' face opposite sides of the support 30, the shape and size of the blocking means 63, 63', . . . may be optimized in order not to block the slit of the filiform elements in the case the final device so requires. Further, the two variants of the embodiments shown in FIGS. 5 and 6 provide for the use of the portion of the supporting strip 64, 64' for the anchorage to the support in the final device. Such a use, which may also occur when the embodiment provides for supporting a single filiform element, allows for the possible use of welding as a fixing process, because it does not lead to risks of undesired overheating of the filiform element. For example, this may be used for fixing the support directly onto the surface of the shield present in some types of lamps. Moreover, with particular reference to the embodiment featuring the support of a pair of filiform elements, this support has the secondary effect of making particularly effective the activation process of the active material.

Useful materials for building the support according to the present invention are, for example, nickel plated iron, cold laminated steel, stainless steel; in a preferred embodiment the material of the support is the same material of the filiform element.

Whenever the filiform element to be inserted is only one (and not at least two as in the embodiments in FIGS. 5 and 6), another alternative embodiment according to the present invention and able to maximize the effectiveness of the activation process by RF source is shown in FIG. 7. A support 70 has been improved by a perforated lateral metal extension 72 able to improve the induced heating currents in correspondence of the filiform element 71 that is fixed to the support by two blocking means 73 and 73'. The lateral metal extension may only optionally act as anchoring mean to the device (for example by welding). In fact similar embodiments are applicable even if also mechanical anchoring elements are present.

Among the getter materials that are more interesting for carrying out the invention, there are those described in U.S. Pat. No. 3,203,901 (zirconium-aluminum alloys), U.S. Pat. No. 4,306,887 (zirconium-iron alloys) and U.S. Pat. No. 5,961,750 (zirconium-cobalt-Rare Earths), all in the Applicant's name. For hydrogen sorption, particularly at high temperatures, it is also known the use of yttrium or alloys thereof, as described in WestingHouse Electric Corporation's patent GB 1,248,184 or in the international patent applications WO03/029502 and WO2007/099575, both in the Applicant's name.

In case the active material comprises powders for mercury release, these are preferably formed of the compounds described in U.S. Pat. No. 3,657,589, that is compounds $Ti_xZ_yHg_z$ wherein x and y vary from 0 to 13, with the proviso that their sum is included between 3 and 13 and z is 1 or 2. In particular, the use of $Ti_3Hg$ is preferred. These compounds may be used also in combination with promoters that maximize the mercury release. Said promoters are formed of copper together with at least one second element selected among tin, indium and silver, as described in patent EP0669639, or of copper and silicon, as described in patent EP0691670, or of copper, tin, and rare earths, as described in patent EP0737995.

Alternatively, mercury-releasing compounds can be used, comprising a weight percentage of titanium ranging from 10% to 42%, of copper ranging from 14% to 50%, of mercury from 20% to 50% and a weight percentage between 1% and 20% of one or more elements selected among tin, chromium and silicon, as described in international application WO2006/008771, or ternary titanium-copper-mercury compounds such as those described in patent GB2056490.

The active material may advantageously comprise, in addition to a mercury compound, also a getter material, for example a Zr—Al alloy comprising 16% of aluminum, described in U.S. Pat. No. 3,203,901, or a Zr—Co-MM alloy, wherein MM indicates Y, La, Ce, Pr, Nd, Rare Earths metals or mixtures of these elements, comprising about 80% by weight of Zirconium, 15% of Cobalt and the rest MM. In this case both the mercury releasing compound and the getter material are present in the filiform element in form of mixed powders and generally having particle size lower than 125 μm.

Typically, the weight ratio between the powders of the mercury releasing compound and the powders of the getter material is comprised between 8:2 and 1:9.

Finally, when the active material is only a getter material, it may be of an evaporable type, such as e.g. Ba—Al or a combination of a Ba—Al alloy with Ni or a getter of a non-evaporable type, such as e.g. yttrium and its binary alloys, Zr—Al, Zr—Co-MM, Zr—Fe—Y alloys or, more generally, Zr-M-Y alloys.

As regards the manufacturing method of a support for filiform elements containing an active material according to the present invention, this preferably involves the use of a starting material formed of a metal strip (preferably steel or nickel plated iron), that also may have a possible metallic or polymeric coating, having the purpose of improving the mechanical or aesthetical features or the features of resistance to corrosion phenomena. The strip is formed by means of two subsequent and automatized steps, respectively of stamping and bending. The possible final riveting step allows for fixing said support element of the filiform element containing the active material.

In a second aspect thereof, the invention relates to a lamp containing a support for filiform elements containing an active material in form of powders, comprising blocking means of the filiform element on said support, anchoring means for said support, characterized in that said blocking means exert a compression on the filiform element that is comprised between 25 and 90 MPa.

In FIG. 8, there is shown a cross-sectional view of a lamp that may contain the support according to the present invention. In particular, a sectional view is represented of a generic high-pressure discharge lamp 80, of the type wherein the electric connectors are only on one side of the lamp, that is formed of an external bulb 81, generally in glass or quartz, wherein the so-called burner 82 is provided, formed of a generally spherical or cylindrical container made of translucent alumina or quartz. At two ends of the burner two electrodes 83, 83' are provided, and inside it a filler gas and one or more metals or compounds in form of vapor or vaporizable by turning on of the lamp (not shown), that are the medium wherein the discharge takes place, are provided; when they are made of quartz, the two ends 84, 84' of the burner are closed by hot compression. The burner is maintained in its position by means of two metal supporting parts, 85, 86 which also have the function of electrically connecting the electrodes and of which one typically has a portion positioned parallely to the burner structure.

In the embodiment shown in FIG. 8, on support 86 there is positioned support 20 for filiform elements, made according to the present invention, positioned between element 86 and bulb 81, parallel to element 86, so as to cause the least possible dimming of the light emission of the lamp.

The structure of the lamp is further completed by external contacts 88, 88', metal feedthroughs 87, 87' and one closure portion of bulb 89.

In a preferred embodiment the anchoring means are fixed by mechanical deformation or by elastically tying the support for filiform elements to one of the structural elements of the lamp, such as for example support threads of the burner (as shown in FIG. 8) or electrical feedthroughs in high-pressure discharge lamps or support wires of the tungsten filament, named lead-wires, or additional wires, known as third electrode, for supporting screening elements in FL.

In the case of FL lamps, the active material comprises powders of mercury releasing compounds, and optionally getter material powders; in the case of high-intensity discharge lamps, the active material comprises getter material powders.

In a particular embodiment, the lamp comprises a support for filiform elements provided with lateral extensions, which support is fixed to one of the lead-wires of the lamp or to the so-called third electrode by means of the anchoring means. Possibly, the lateral extensions having suitable length could be bent and shaped so as to have a shield in form of a closed or semi-closed ring around the electrode or, as previously mentioned, it could be placed above the electrode at a suitable distance.

The invention will be further illustrated by means of the following examples. These non-limiting example illustrate some embodiments which are intended to teach the skilled persons how to put the invention into practice and to represent the best mode to carry out the invention.

EXAMPLE 1

An active material containing system has been obtained by fixing with a compression action of about 42 MPa a filiform element (length about 5 mm, and a trapezoidal cross-section having a maximum transversal width about 1 mm and height about 0.8 mm) on a support according to the present invention as shown in FIG. 4. Under vacuum conditions (pressure lower than $10^{-4}$ mbar), the system has been heated for 20 and 30 seconds by an induction coil with a diameter of 40 mm, coil connected to an RF power source with a nominal power of 2 KW. The system, during the test, has been perpendicularly coupled to the electro-magnetic field. In Table 1 the deformation of the cross-section of the filiform element as effect of the compression action and the effective temperatures obtained by RF induction have been reported

EXAMPLE 2 (COMPARATIVE)

An active material containing system has been obtained by fixing a filiform dispensing element as in the Example 1 but using a compression action of about 18 MPa. In Table 1 the deformation of the cross-section of the filiform element as effect of the compression action and the effective temperatures obtained by RF induction have been reported

TABLE 1

| Example | Compression action (MPa) | Deformation (%) | Time (sec) | T (° C.) |
|---|---|---|---|---|
| 1 | 42 | 3.2 | 20 | 455 |
| | | | 30 | 533 |
| 2 | 18 | 1.3 | 20 | 358 |
| | | | 30 | 441 |

As shown by the example, a support obtained according the present invention is not only able to guarantee an effective blocking of the filiform element, but also an improved heating thereof during the activation process: the sample according to the present invention described in the Example 1, in fact, is heated to temperature above 500° C. (as requested by the most popular active materials) after 30 seconds, as required in the manufacturing production line of several devices. The comparative example, even if the filiform element is blocked on the support, does not meet the required efficiency in the activation step because temperature have seen to be lower than the desired ones.

The invention claimed is:

1. A support for at least one filiform element containing an active material in form of powders, the support comprising blocking means of each filiform element on said support; and anchoring means for said support, said anchoring means being connected with said blocking means and being adapted to anchor the support to a structural element, wherein said blocking means exert a compression on the filiform element between 25 and 90 MPa.

2. The support according to claim 1 wherein said compression is comprised between 25 and 55 MPa.

3. The support according to claim 1 wherein the blocking means partially contacts the filiform element and wherein a cross-section area of the filiform element contacted by the blocking means is less than a cross-section area of the filiform element not contacted by said blocking means by an amount less than 8%.

4. The support according to claim 3 wherein the amount is in the range from 1.5% to 4%.

5. The support according to claim 1 wherein said anchoring means hold by crimping or solely by elastic force.

6. The support according to claim 1 wherein said blocking means are present on an ending part of the filiform element and are provided with a bent terminal section.

7. The support according to claim 6 wherein said bent terminal section covers no more than 60% of the area of said ending part the filiform element.

8. The support according to claim 1 wherein lateral extensions are provided.

9. The support according to claim 1 wherein the material of the support is nickel plated iron or steel.

10. The support according to claim 1 wherein said filiform element is provided with a slit on a lateral surface.

11. The support according to claim 1 wherein said filiform element contains powders of one or more getter materials.

12. The support according to claim 1 wherein said filiform element contains powders of one or more compounds for mercury release.

13. The support according to claim 12 wherein said filiform element also contains powders of one or more getter materials.

14. A lamp comprising the support for filiform elements containing powders of an active material according to claim 1.

15. The lamp according to claim 14 wherein said lamp is a low pressure mercury lamp.

16. The lamp according to claim 14 wherein said active material comprises powders of one or more compounds for mercury release.

17. The lamp according to claim 16 wherein said active material comprises powders of one or more getter materials.

18. The lamp according to claim 14 wherein said lamp comprises a burner.

19. The lamp according to claim 18 wherein said active material comprise powders of one or more getter materials.

20. The support according to claim 1 wherein the anchor means are connected with said blocking means both in an operative and in a non-operative condition of the support.

21. The support according to claim 1, further comprising at least one lateral metal extension located on a lower portion of the support.

22. The support according to claim 1, further comprising a perforated lateral extension located on a lower portion of the support.

23. The support according to claim 1, wherein the anchoring means is configured as a perforated lateral extension.

* * * * *